US006256910B1

(12) United States Patent
Grozde

(10) Patent No.: US 6,256,910 B1
(45) Date of Patent: Jul. 10, 2001

(54) SNOWPLOW BLADE EXTENSION DEVICE

(76) Inventor: James G. Grozde, 24215 Murray, Clinton Township, MI (US) 48035

( * ) Notice: Subject to any disclaimer, the term of this patent is extended or adjusted under 35 U.S.C. 154(b) by 0 days.

(21) Appl. No.: 09/408,577

(22) Filed: Sep. 29, 1999

(51) Int. Cl.[7] ..... E01H 5/06
(52) U.S. Cl. ..... 37/266; 37/219; 172/817
(58) Field of Search ..... 37/231, 219, 232, 37/266, 267, 270; 172/810, 811, 817

(56) References Cited

U.S. PATENT DOCUMENTS

| | | | | |
|---|---|---|---|---|
| 2,061,585 | * | 11/1936 | Meyer | 37/42 |
| 2,285,039 | | 6/1942 | Lowe . | |
| 2,936,537 | * | 5/1960 | Bain | 37/19 |
| 3,466,766 | * | 9/1969 | Kahlbacher | 37/41 |
| 3,477,149 | * | 11/1969 | Wagner | 37/50 |
| 3,772,803 | | 11/1973 | Cote . | |
| 4,259,794 | * | 4/1981 | Rath | 37/42 |
| 4,723,609 | * | 2/1988 | Curtis | 172/815 |
| 4,731,942 | * | 3/1988 | Eberle | 37/272 |
| 5,014,961 | * | 5/1991 | Ferguson | 248/670 |
| 5,140,763 | | 8/1992 | Nichols, IV . | |
| 5,392,538 | * | 2/1995 | Geerligs et al. | 37/268 |
| 5,611,157 | | 3/1997 | Ferreira . | |
| 5,638,617 | * | 6/1997 | Belanger et al. | 37/270 |
| 5,655,318 | * | 8/1997 | Daniels | 37/231 |
| 5,715,613 | | 2/1998 | Ebert . | |
| 5,806,213 | * | 9/1998 | Doornek et al. | 37/231 |
| 5,819,443 | * | 10/1998 | Winter | 37/233 |
| 5,894,689 | * | 4/1999 | Turk | 37/281 |
| 5,930,922 | * | 8/1999 | Altheide | 37/268 |
| 5,960,569 | * | 10/1999 | Molstad | 37/231 |
| 6,012,240 | * | 1/2000 | Klug et al. | 37/231 |
| 6,112,438 | * | 9/2000 | Weagley | 37/270 |

* cited by examiner

*Primary Examiner*—Victor Batson
(74) *Attorney, Agent, or Firm*—Dykema Gossett PLLC

(57) ABSTRACT

Snowplow blade extensions for two conventional snowplows to remove snow and/or ice in forward and rearward directions. One embodiment comprises a forward rectangular blade having a rear rectangular blade attached to its rear face at an acute angle by spaced gussets to form two legs with bevelled bottom edges. The upper portion of the forward rectangular blade is bolted on the bottom front face of the snowplow blade. The other embodiment utilizes a pair of brackets on the rear of the snowplow blade to hang the rearward extension blade and cooperate with the existing forward extension blade at the bottom edge of the forward face of the snowplow blade to form an inverted V formation of two legs with bevelled edges contacting the ground surface to be cleared of snow and/or ice in both forward and rearward directions.

2 Claims, 3 Drawing Sheets

SNOWPLOW BLADE EXTENSION DEVICE

BACKGROUND OF THE INVENTION

1. Field of the Invention

The present invention relates generally to a snowplow blade extension device. More specifically, extension blades for two different brand snowplow blades are disclosed which attach to the bottom of the blades for plowing snow and ice backwards as well as forward.

2. Description of the Related Art

There exists a need for a snowplow constructed so that snow and ice can be plowed backwards as well as forward, as in the instant invention. The related art of interest describes various snowplow blades, but none disclose the attachment devices of the present invention.

The related art of interest will be described in the order of perceived relevance to the present invention.

U.S. Pat. No. 5,715,613 issued on Feb. 10, 1998, to Fred Ebert describes a back plow blade removably secured to the bottom edge of a snowplow for collecting snow and ice in either direction of travel. The blade is constructed of carbon steel alloy with a flat forward inclined (at 45°) plow surface blade which has a vertical rearward plow surface blade attached to it by welding trapezoidal shaped reinforcement ribs. The upper extent of the forward plow is bolted to the snowplow at positions which are staggered with respect to the ribs. The lower extent of the rearward plow is pointed. The back plow blade is distinguishable for its vertically positioned rearward plow with a narrow pointed edge which would wear quickly and become blunted during use.

U.S. Pat. No. 5,140,763 issued on Aug. 25, 1992, to Charles W. Nichols, IV describes a secondary snow removal structure attached to the rear of a snowplow. A reinforced shelf supports a plurality of adjacently positioned and inverted L-shaped fingers by vertically aligned individual bolts having one or two springs each. If the fingers are made from resilient material, no springs would be required. The forward edges of the fingers have eyelets for rotation of the fingers on a horizontal pivot pin supported by spaced brackets attached to the rear surface of the snowplow. The fingers can have replaceable extensions made of either metal or plastic bolted on. The secondary snow removal structure is distinguishable for its fingered structure.

U.S. Pat. No. 5,611,157 issued on Mar. 18, 1997, to Thomas Ferreira describes a wear pad assembly attached to a lip of a bucket to protect the bucket lip but also the ground worked on. The pads are made from rubber tires and held together in a bracket with metal rods. The bracket is bolted onto to the lip of the bucket. The wear pad assembly is distinguishable for its essential wearable quality.

U.S. Pat. No. 3,772,803 issued on Nov. 20, 1973, to Lucien Cote describes a scraping bar for a snowplow which can swing back when meeting an obstacle and can return to its original scraping position under spring pressure. The scraping bar has at least three separate sections. The scraping bar is distinguishable for its essential spring action.

U.S. Pat. No. 2,285,039 issued on Jun. 2, 1942, to Jack F. Lowe describes a blade attachment for earth excavating and handling machines having a J-shaped cross-section with a series of apertures for bolting on the lower edge of the mold board. The rear portion can be separated and spaced portions. The blade can be in three portions. The blade attachment is distinguishable for its single scraping blade.

None of the above inventions and patents, taken either singularly or in combination, is seen to describe the instant invention as claimed. Thus, a snowplow blade extension which can effectively plow forward and rearward, and yet readily installable on various snowplows is desired.

SUMMARY OF THE INVENTION

Accordingly, it is a principal object of the invention to provide an attachment blade having at least a rear blade for a snowplow blade.

It is another object of the invention to provide an attachment blade for at least two different snowplow blades.

It is a further object of the invention to provide an attachment blade for a Western & Meyer snowplow which has a front blade bolted on and supported by a gusseted rear facing blade.

Still another object of the invention is to provide a rear attachment blade with hanger posts for mounting on brackets on the rear bottom edge of a Fisher snowplow.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to two snowplow attachment devices which permit the reverse scraping of snow and ice by a snowplow.

Figure 1:
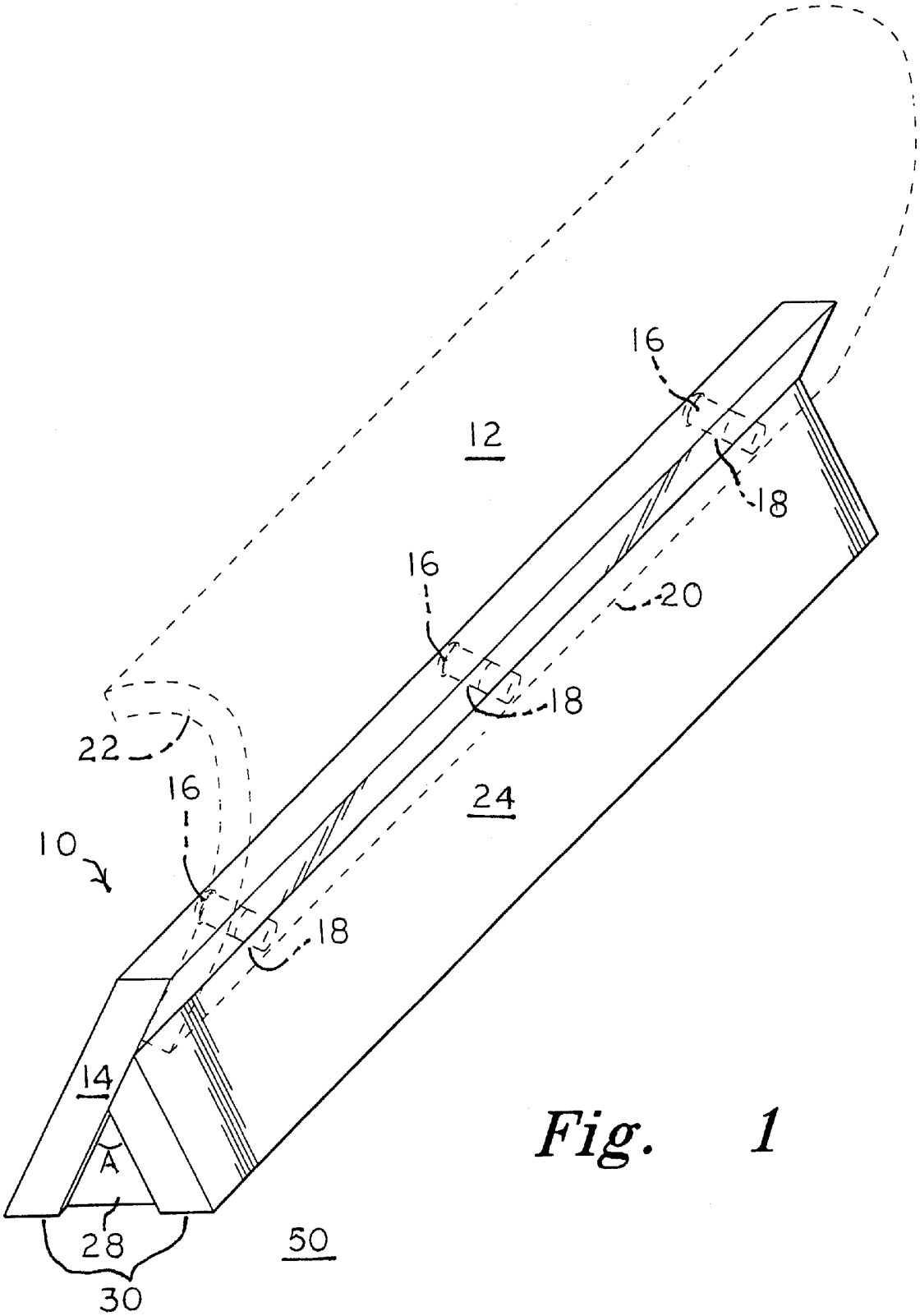
FIG. 1 is a side elevational view of a snowplow blade extension device having a front and rear blade construction attached to a Western & Meyer snowplow blade according to a first embodiment of the present invention.
Figure 2:
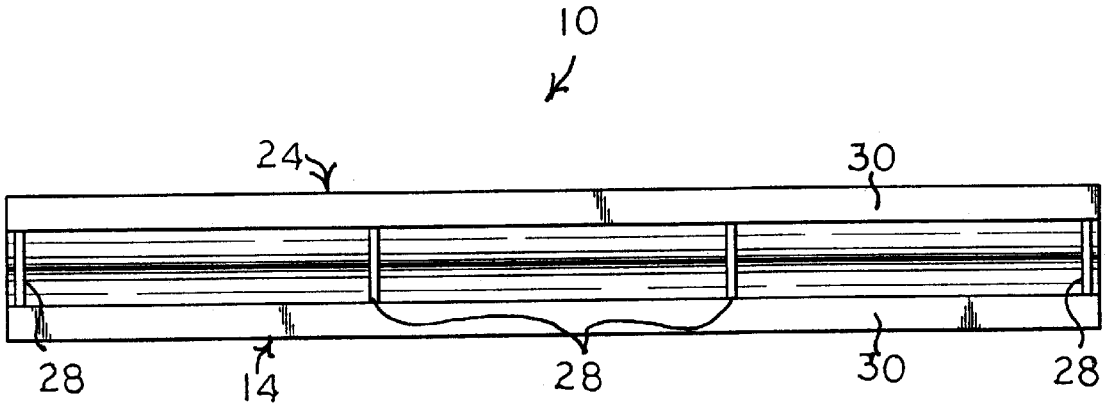
FIG. 2 is a bottom view of the snowplow blade extension device of FIG. 1.

In FIGS. 1 and 2, a first embodiment of the snowplow blade extension device 10 is illustrated for attaching to a Western & Meyer Co. snowplow blade 12. A forward rectangular and planar blade portion 14 is fastened by bolts 16 using available bolt holes 18 adjacent the bottom edge 20 of the snowplow blade 12 and inclined forwardly from the front face 22. A rearward rectangular and planar blade portion 24 is attached to and coextensive in length with the rear face 26 of the forward blade portion 14 at an acute angle A. An equally spaced plurality of triangular gussets 28 are attached by welding to said forward and rearward blade portions 14, 24, respectively, at each end and in between for reinforcement.

In this first embodiment, the forward and rearward blade portions 14, 24, are positioned comparatively close together with their bevelled edges 30 horizontal to the ground surface 50 to apply a maximum scraping surface for removing snow and ice in both forward and rearward directions of the snowplow.

Figure 3:
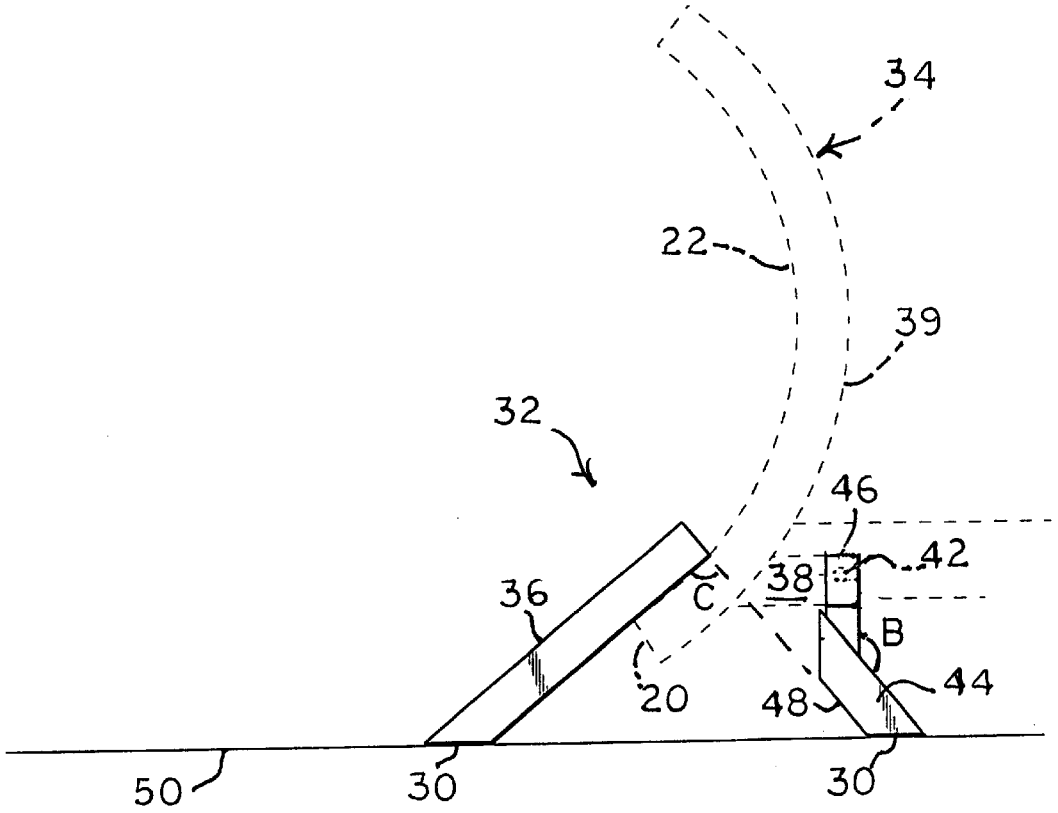
FIG. 3 is a side elevational view of a rear snowplow blade extension device attached to a Fisher snowplow blade according to a second embodiment of the present invention.
Figure 4:
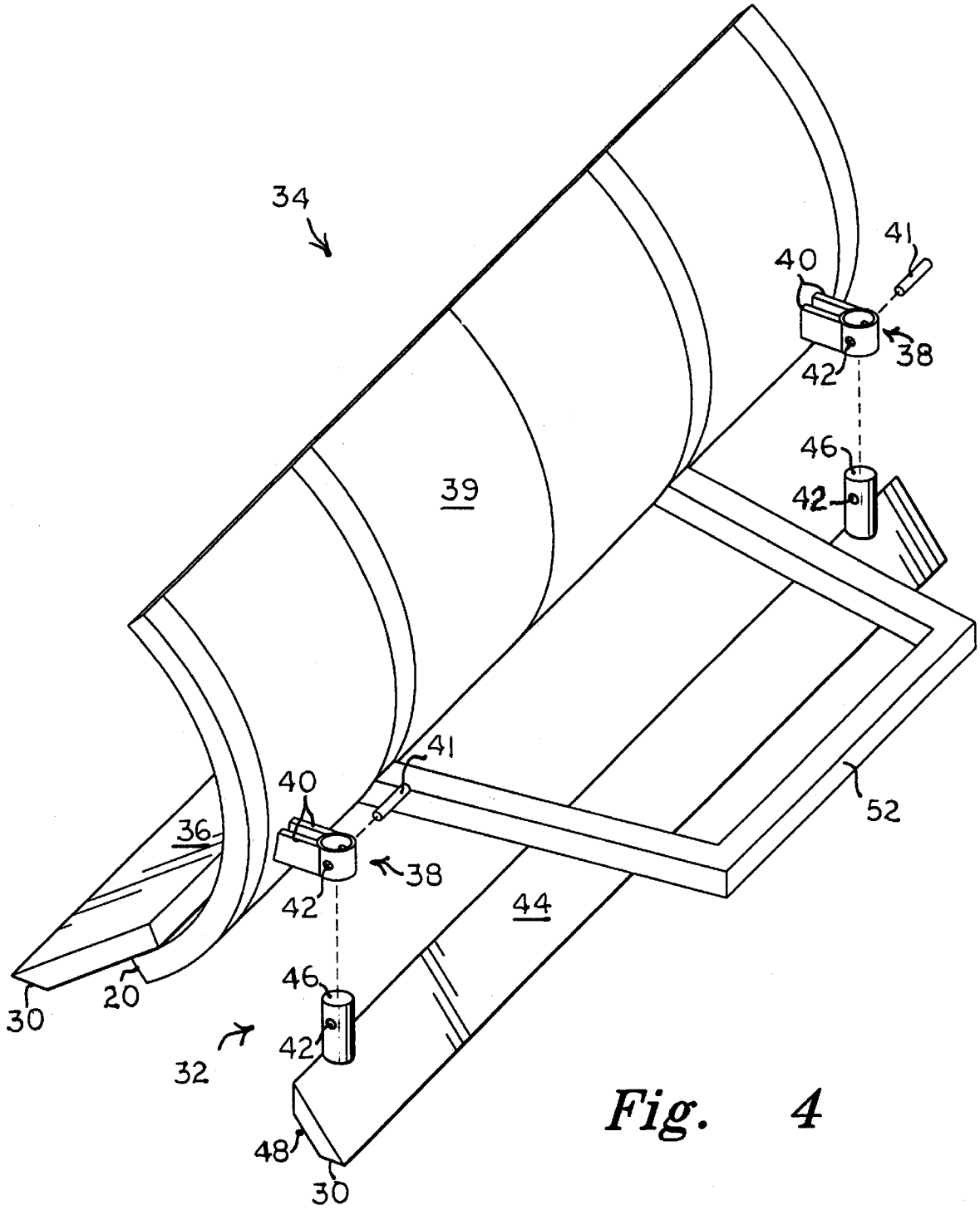
FIG. 4 is an exploded perspective view of the FIG. 3 embodiment.

In FIGS. 3 and 4, a second embodiment of a snowplow blade extension device 32 for a snowplow blade 34 made by the Fisher Co. is shown. The snowplow blade 34 has a preexisting forward rectangular and planar blade portion 36 with a bevelled bottom edge 30 inclined forwardly and on the bottom edge 20 of the front face 22 of the snowplow blade 34. Also, a U-shaped support bar 52 is attached to the rear of the snowplow blade 34 for attachment to the tractor (not shown). A pair of apertured tubular brackets 38 are positioned proximate to the ends of the rear face 39 of the snowplow blade 12 on a pair of legs 40 for spacing the brackets 38. A pin 41 is provided in apertures 42 in each bracket 38.

A rearward rectangular and planar blade portion 44 which is coextensive in length with the forward blade portion 36 and having a bevelled edge 30 has a pair of apertured cylindrical posts 46 which are positioned vertically at an obtuse angle B to the rear face 48 of the rearward blade portion 44 and hung from the brackets 38 by intersecting pins 41 on the rear face 39 of the snowplow blade 34. The forward and rear blade portions 36 and 44, respectively, form approximately a right angle C and the bevelled edges 30 thereof contact a ground surface 50.

Thus, two structurally different snowplow blade extension devices 10 and 32 has been shown which can be incorporated readily on conventional snowplow blades 12 and 34 to effectively clean snow and ice in both forward and rearward directions resulting in maximizing the scraping effect while minimizing the movements of the snowplow tractor.

It is to be understood that the present invention is not limited to the embodiments described above, but encompasses any and all embodiments within the scope of the following claims.

I claim:

1. A snowplow blade extension device for a snowplow blade used for cleaning snow and ice accumulations forwardly and rearwardly comprising:

a forward rectangular, planar and rigid blade portion inclined forwardly and fastened on a bottom edge of a snowplow blade, said forward planar blade portion having a front face, a rear face and beveled bottom surface;

a rearward rectangular, planar and rigid blade portion having a front face, a rear face, a beveled top surface and a beveled bottom surface, said rearward blade portion being coextensive in length with and attached to the rear face of said forward blade portion, the beveled top surface of said rearward blade portion abutting the rear face of said forward blade portion, with the front face of said rearward blade portion being opposite from and forming an acute angle with the rear face of said forward blade portion;

said beveled bottom surfaces of said forward and rearward blade portions occupying a horizontal plane; and a plurality of triangular gussets attached to the opposite faces of said rigid forward and rearward blade portions for reinforcement;

said beveled surfaces of the forward and rearward blade portions contacting a ground surface covered by snow and ice accumulations, with said forward blade portion pushing a portion of the snow and ice accumulations when the forward blade portion is moved forwardly and said rearward blade portion pushing a portion of the snow and ice accumulations when the rearward blade portion is moved rearwardly.

2. A snowplow blade extension device for a snowplow blade having a preexisting forward rectangular, planar and rigid blade portion with a beveled bottom edge inclined forwardly and on a bottom edge of a front face of a snowplow blade for cleaning snow and ice accumulations forwardly and rearwardly comprising:

a rearward rectangular, planar and rigid blade portion coextensive in length with said forward blade portion and having a front face, a rear face, a beveled top surface and a beveled bottom edge;

a pair of longitudinally spaced apart horizontal mounting brackets having vertically positioned cylindrical apertured tubes, each tube spaced from a pair of legs attached to a bottom portion of the rear face of the snowplow blade; and a pair of apertured posts which are vertically positioned and secured at an included obtuse angle to the rear face of said rearward blade portion and received in said tubes and hung from the mounting brackets on the rear face of the snowplow blade by removable pins;

said beveled bottom edges of said rigid forward and rearward blade portions occupying a horizontal plane;

said forward and rearward blade portions forming a right angle and the beveled edges thereof contacting a ground surface covered by snow and ice accumulations, with said forward blade portion pushing a portion of the snow and ice accumulations when the forward blade portion is moved forwardly and said rearward blade portion pushing a portion of the snow and ice accumulations when the rearward blade portion is moved rearwardly.

* * * * *